US006571437B2

(12) United States Patent
Liu

(10) Patent No.: US 6,571,437 B2
(45) Date of Patent: Jun. 3, 2003

(54) DOUBLE-BOW SHOE LACE DEVICE

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 09/920,945

(22) Filed: Aug. 3, 2001

(65) Prior Publication Data

US 2003/0024084 A1 Feb. 6, 2003

(51) Int. Cl.[7] ..... A43C 7/00
(52) U.S. Cl. ..... 24/712.2; 24/712.5
(58) Field of Search ..... 24/115 G, 712–712.9; 36/50.1

(56) References Cited

U.S. PATENT DOCUMENTS 2,869,204 A * 1/1959 Mopps
3,103,725 A * 9/1963 Robb et al.
4,112,551 A * 9/1978 Sales
4,393,550 A * 7/1983 Yang et al.
5,293,675 A * 3/1994 Shai
5,335,400 A * 8/1994 Sales

FOREIGN PATENT DOCUMENTS

JP 10-225306 * 8/1998

* cited by examiner

*Primary Examiner*—James R. Brittan
(74) *Attorney, Agent, or Firm*—Foley & Lardner

(57) ABSTRACT

A double-bow shoe lace device for a shoe includes a shoe lace, a clamp member, and a positioning unit. The shoe lace has first and second lace portions, each of which has lower, upper, and medial sections. The lower sections of the lace portions are anchored on eyelet tabs of the shoe. The upper sections of the lace portions are tied together to form a knot and a pair of distal lace ends. The clamp member is sleeved slidably on the medial sections of the lace portions. Downward and upward movements of the clamp member along the lace portions permit the tightening and loosening of the shoe. The positioning unit positions the knot on the clamp member such that the medial sections of the lace portions form first and second loops between the knot and the clamp member.

10 Claims, 11 Drawing Sheets

DOUBLE-BOW SHOE LACE DEVICE

BACKGROUND OF THE INVENTION

1. Field of the Invention

The invention relates to a shoe lace device, more particularly to a double-bow shoe lace device for a shoe.

2. Description of the Related Art

Referring to FIG. 1, a conventional shoe lace device 1 of a shoe 4 includes a shoe lace 2 having first and second lace sections 201, 202, and a clamp member 3. The first lace section 201 is strung on a shoe body 41 so as to form a criss-cross pattern on eyelet tabs 5 of the shoe body 41. The second lace section 202 is formed as a simple loop, and has lower ends 2021 connected to the first lace section 201, thereby anchoring the lower ends 2021 on the eyelet tabs 5, respectively. The clamp member 3, as shown in FIG. 2, includes an elongate casing 301, a clamping block 302, and a spring member 303. The elongate casing 301 is formed with a lateral open end 3010 for receiving the clamping block 302*f* a closed end 3011 opposite to the open end 3010, and a vertically extending hole unit 301' for extension of the lower ends 2021 of the second lace section 202 therethrough. The clamping block 302 is slidably received in the open end 3010 of the casing 301, and is formed with a vertically extending slot unit 3021 that corresponds to the hole unit 301' of the casing 301 for extension of the lower ends 2021 of the second lace section 202 therethrough. The spring member 303 is disposed in the casing 301, and has opposite ends that abut respectively against the clamping block 302 and the closed end 3011 of the casing 301. As such, the clamping block 302 is biased by the spring member 303 so as to misalign the slot unit 3021 from the hole unit 301' in order to clamp the second lace section 202 between the clamping block 302 and the casing 301.

To tighten the shoe 4, the clamp member 3 is forced to move downwardly along the second lace section 202, thereby bringing the lower ends 2021 of the second lace section 202 closer together.

To loosen the shoe 4, the clamping block 302 is operated to align the slot unit 3021 with the hole unit 301' against action of the spring member 303, and the clamp member 3 is then moved upwardly along the second lace section 202, thus permitting the lower ends 2021 of the second lace section 202 to move away from each.

Although the aforesaid shoe lace device 1 is easy to use, the simple loop configuration of the second lace section 202 has an unattractive appearance.

SUMMARY OF THE INVENTION

Therefore, the main object of the present invention is to provide a double-bow shoe lace device for a shoe.

Accordingly, a double-bow shoe lace device of this invention is adapted for use with a shoe having a pair of eyelet tabs and a tongue between the eyelet tabs. The shoe lace device comprises a shoe lace, a clamp member, and a positioning unit. The shoe lace has first and second lace portions, each of which has a lower section, an upper section, and a medial section between the lower and upper sections. The lower section of each of the first and second lace portions is adapted to be anchored on a respective one of the eyelet tabs. The upper sections of the first and second lace portions are tied together to form a knot and a pair of distal lace ends that extend from the knot. The clamp member is sleeved slidably on the medial sections of the first and second lace portions. Downward movement of the clamp member along the medial sections brings the lower sections of the first and second lace portions closer together for tightening the shoe. Upward movement of the clamp member along the medial sections permits the lower sections of the first and second lace portions to move away from each for loosening the shoe. The positioning unit is connected to the knot and the clamp member, and positions the knot on the clamp member such that the medial sections of the first and second lace portions form first and second loops between the knot and the clamp member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
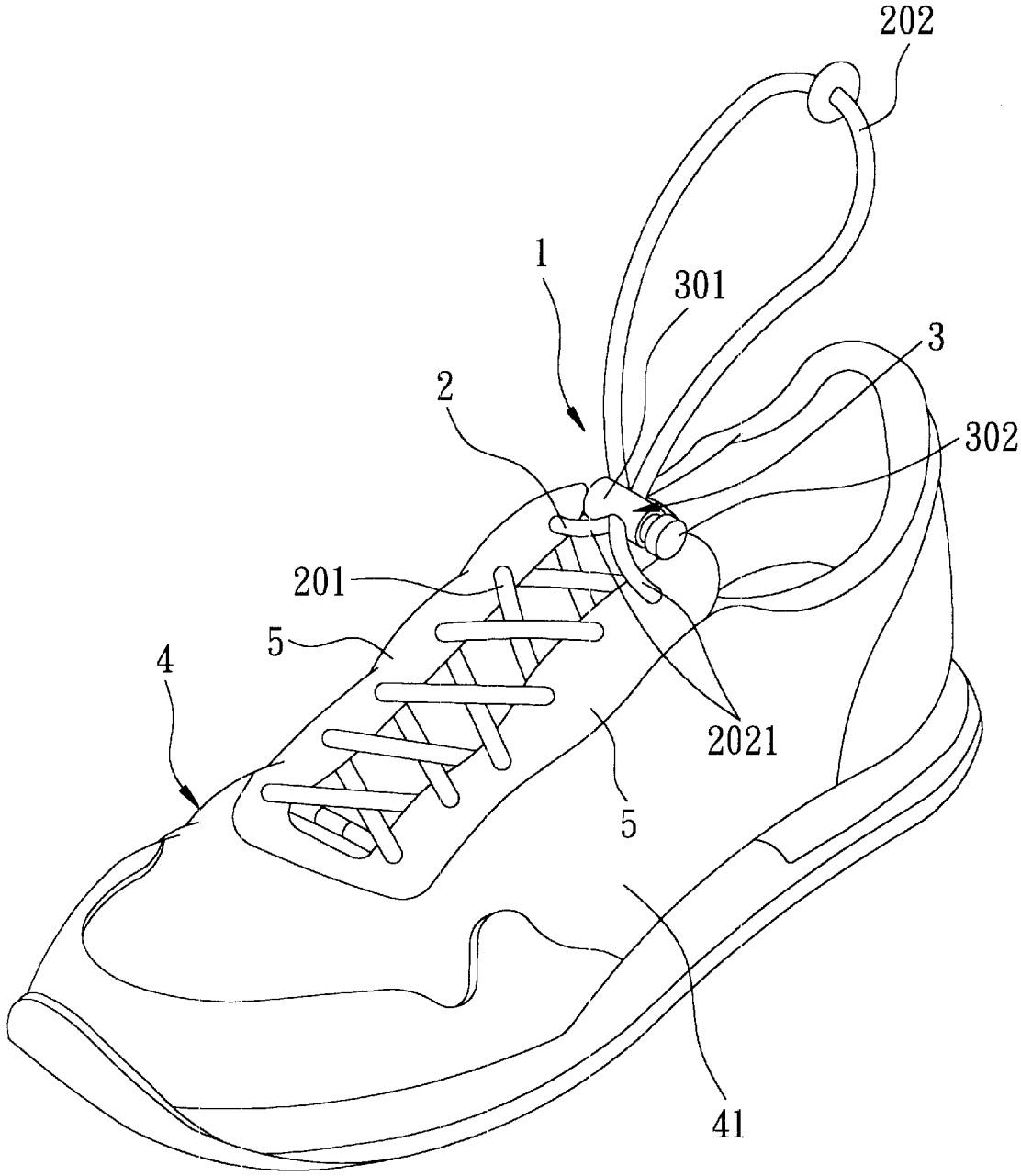
FIG. 1 PRIOR ART
FIG. 1 is a perspective view of a shoe with a conventional shoe lace device.
Figure 2:
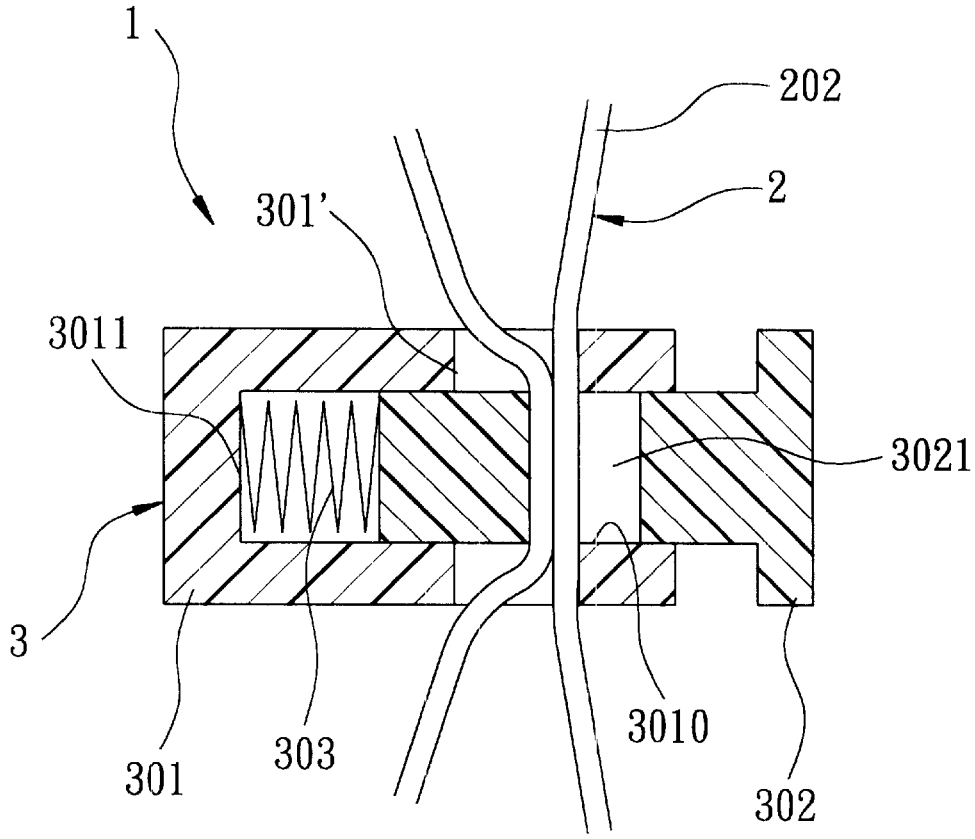
FIG. 2 PRIOR ART
FIG. 2 is a cross-sectional view of a clamp member of the conventional shoe lace device.

Before the present invention is described in greater detail, it should be noted that like elements are denoted by the same reference numerals throughout the disclosure.

Figure 3:
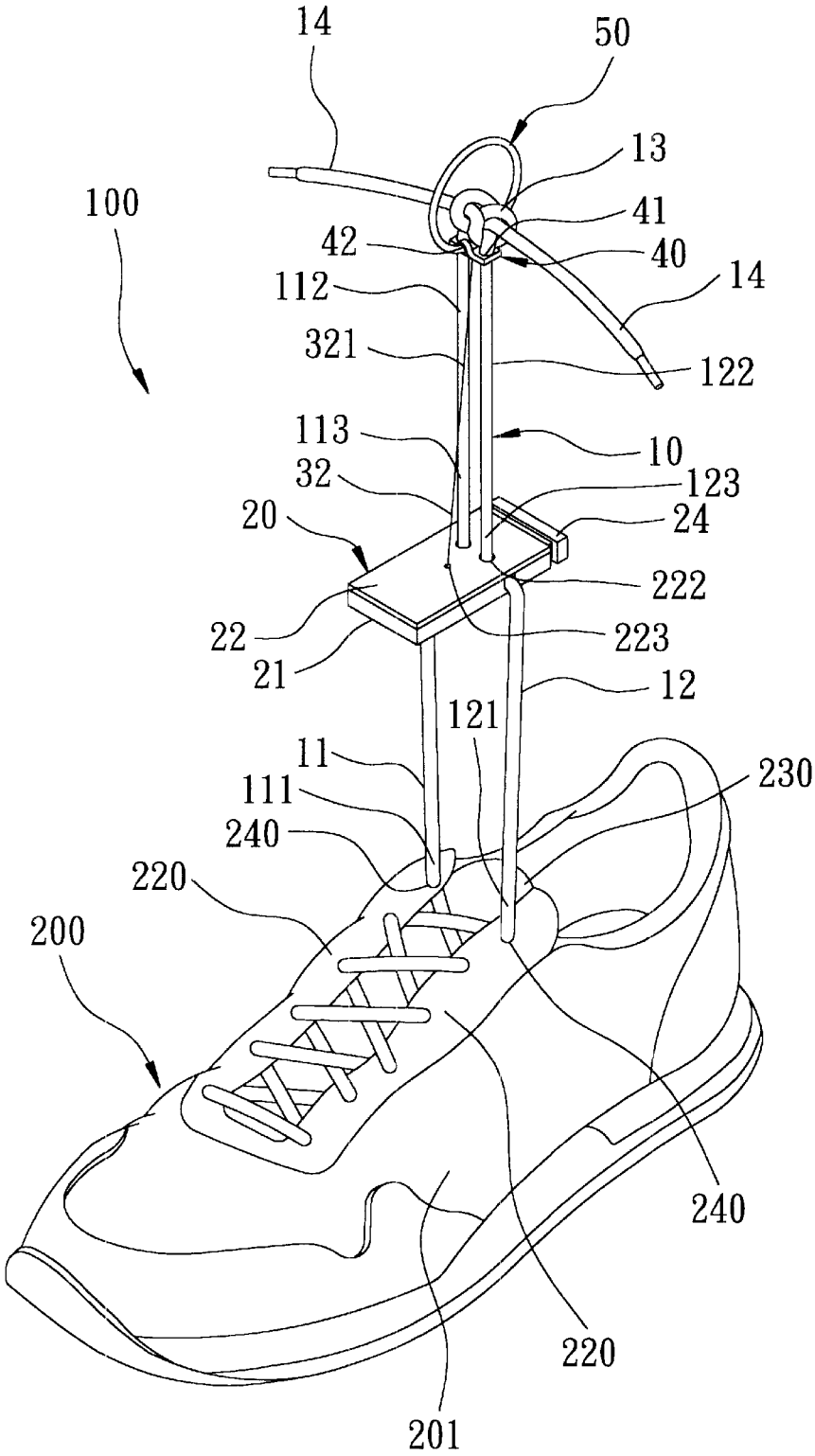
FIG. 3 is a perspective view of the first preferred embodiment of a double-bow shoe lace device according to the present invention.

Referring to FIG. 3, the first preferred embodiment of a double-bow shoe lace device 100 according to the present invention is shown to be adapted for use with a shoe 200 having a pair of eyelet tabs 220 and a tongue 230 between the eyelet tabs 220. The shoe lace device comprises a shoe lace 10, a clamp member 20, and a positioning unit 30. The shoe lace 10 has a first lace segment that is strung on a shoe body 201 in a conventional manner so as to form a criss-cross pattern on the eyelet tabs 220, and a second lace segment that includes first and second lace portions 11, 12. Each of the first and second lace portions 11, 12 has a lower section 111, 121, an upper section 112, 122, and a medial section 113, 123 between the lower and upper sections 111, 121, 112, 122. The lower section 111, 121 of each of the first and second lace portions 11, 12 is anchored on a respective one of the eyelet tabs 220. The upper sections 112, 122 of the first and second lace portions 11, 12 are tied together to form a knot 13 and a pair of distal lace ends 14 that extend from the knot 13.

Figure 4:
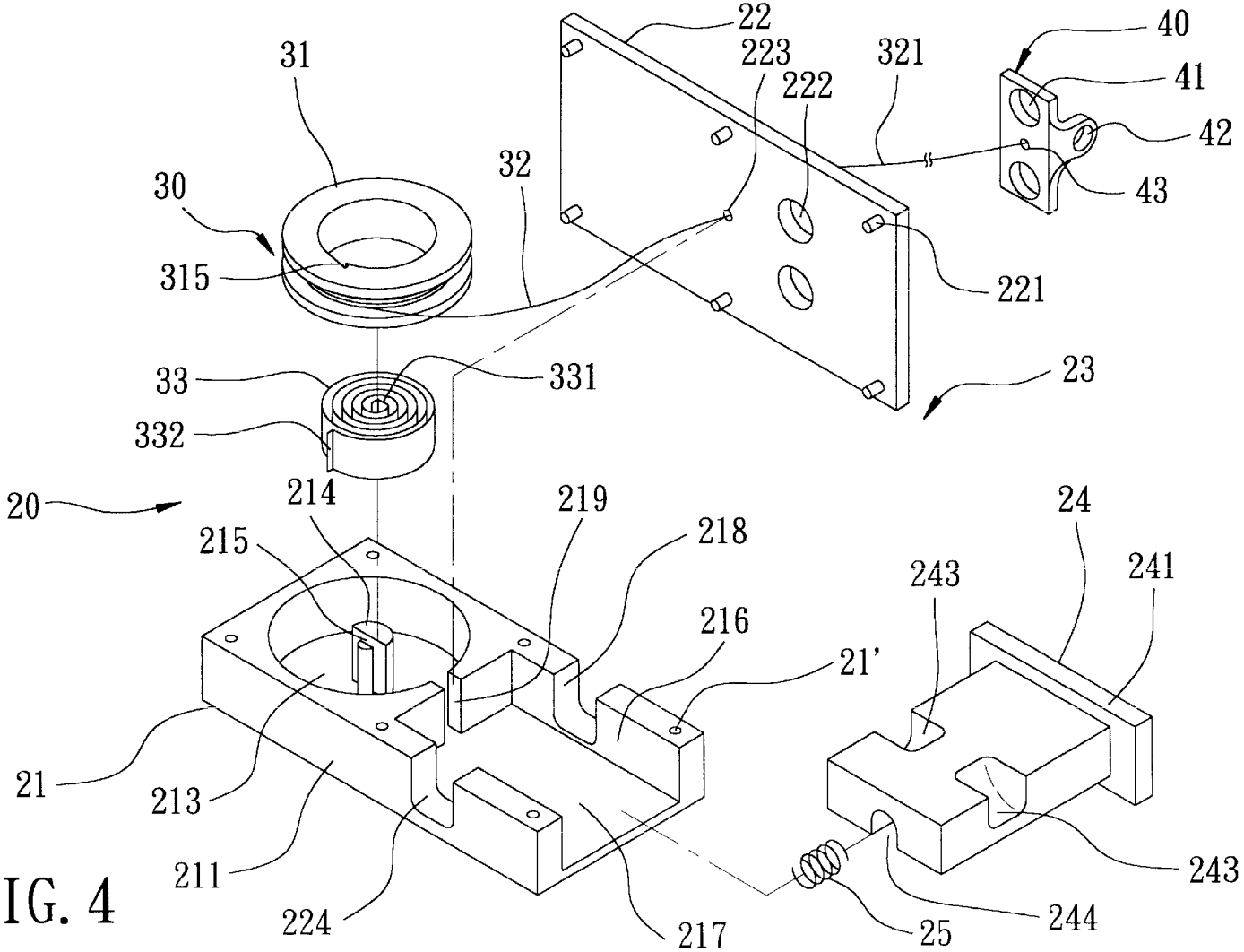
FIG. 4 is an exploded perspective view showing a clamp member, a positioning unit, and a guide plate of the first preferred embodiment.

With further reference to FIG. 4, the clamp member 20 is sleeved slidably on the medial sections 113, 123 of the first and second lace portions 11, 12, and includes an elongate casing 23, a clamping block 24, and a second biasing member 25. The elongate casing 23 includes a lower base 21 with an upright peripheral wall 211, and an upper cover plate 22 mounted on the upright peripheral wall 211. The upright peripheral wall 211 is formed with a plurality of pin holes 21'. The lower base 21 is formed with a reel accommodating portion 213, a lace retention portion 216 adjacent to the reel accommodating portion 213, and a channel 219 between the reel accommodating and lace retention portions 213, 216. The reel accommodating portion 213 has two upright posts 214 that define a groove 215 therebetween. The lace retention portion 216 has an open lateral side 217 and is formed with a pair of lower hole parts 224 that permit extension of the medial sections 113, 123 of the first and second lace portions 11, 12 therethrough. The upper cover plate 22 has a plurality of pins 221, and is formed with a string hole 223 and a pair of upper hole parts 222. The upper hole parts 222 in the upper cover plate 22, and the lower hole parts 224 in the upright peripheral wall 211 cooperate to form a pair of hole units 218. The pins 221 of the upper cover plate 22 engage the pin holes 21' in the lower base 21, respectively.

The clamping block 24 is slidably received in the lace retention portion 216, is formed with a pair of groove units 243 that correspond respectively to the hole units 218 in the lace retention portion 216 for extension of the medial sections 113, 123 of the first and second lace portions 11, 12, and a positioning hole 244.

Figure 5:
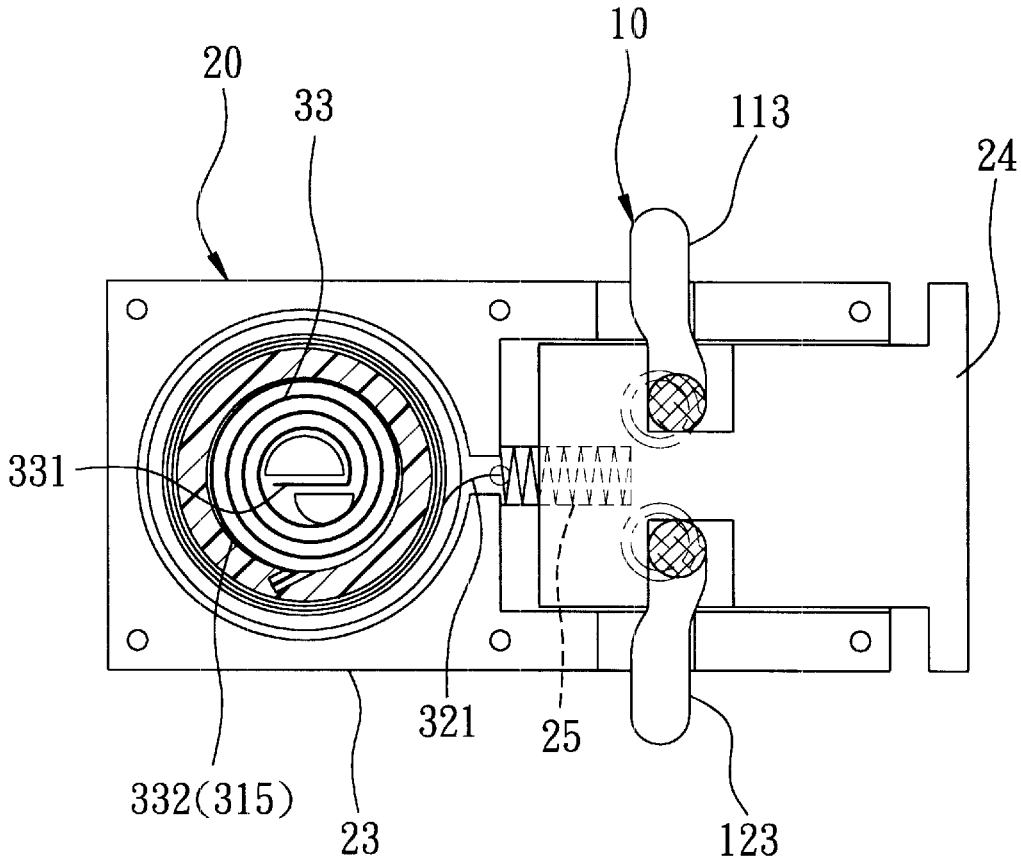
FIG. 5 is a schematic partly cross-sectional view of the clamp member illustrating how the members of the positioning unit are interconnected in a reel accommodating portion of a casing, and how a second biasing member biases a clamping block in the first preferred embodiment.

The second biasing member 25 extends into the positioning hole 244 of the clamping block 24, is disposed in the lace retention portion 216, and biases the clamping block 24 toward the open lateral side 217 of the lace retention portion 216, thereby clamping the medial sections 113, 123 of the first and second lace portions 11, 12 between the clamping block 24 and the casing 23, as best illustrated in FIG. 5.

Downward movement of the clamp member 20 along the medial sections 113, 123 brings the lower sections 111, 121 of the first and second lace portions 11, 12 closer together for tightening the shoe 200. Upward movement of the clamp member 20 along the medial sections 113, 123 permits the lower sections 111, 121 of the first and second lace portions 11, 12 to move away from each other for loosening the shoe 200.

Figure 7:
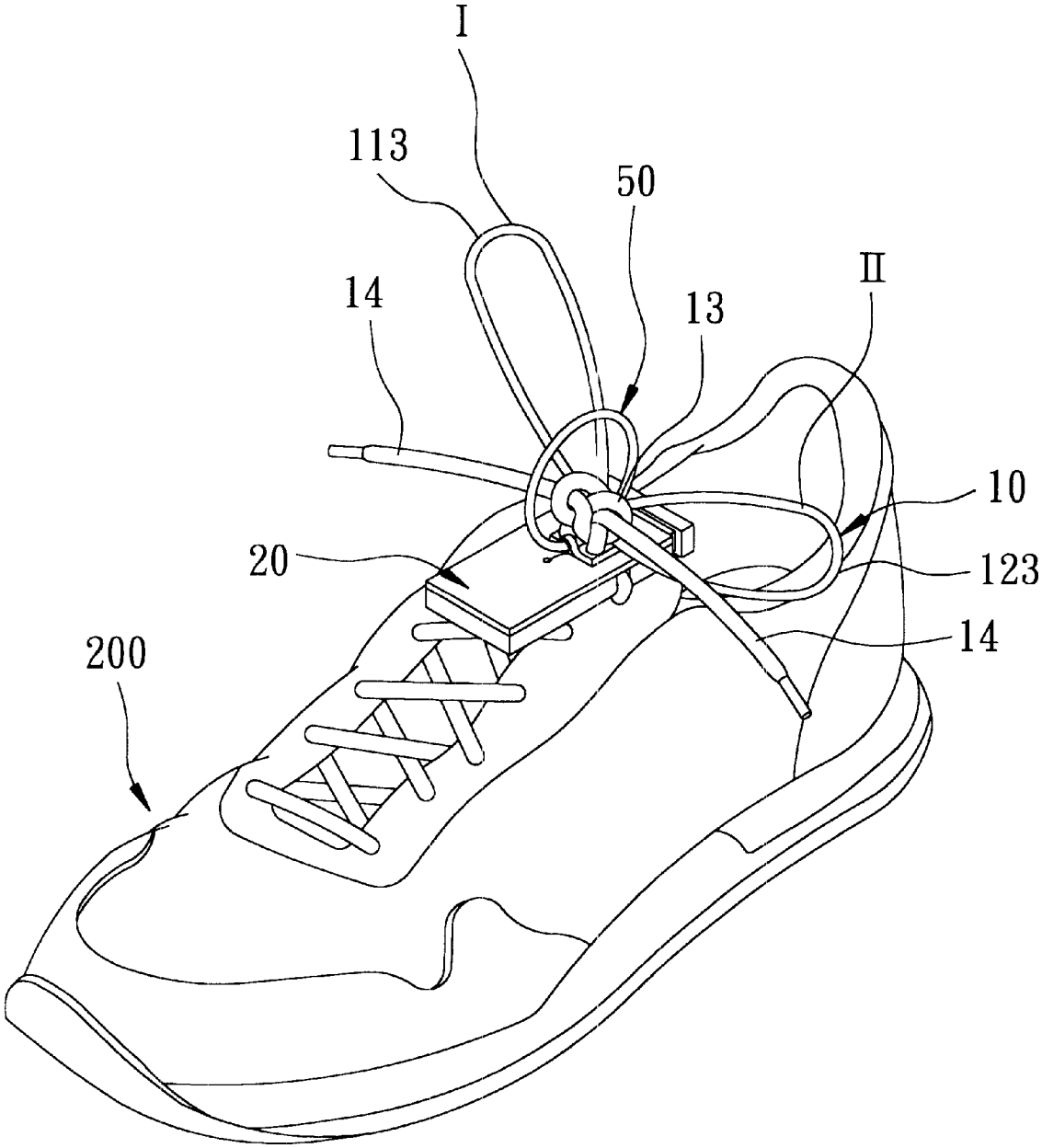
FIG. 7 is a perspective view showing a shoe with the double-bow shoe lace device of the first preferred embodiment.

The positioning unit 30 is connected to the knot 13 and the clamp member 20, and positions the knot 13 on the clamp member 20 so that the medial sections 113, 123 of the first and second lace portions 11, 12 form first and second loops (I), (II) between the knot 13 and the clamp member 20, as shown in FIG. 7. Referring once again to FIG. 4, the positioning unit 30 includes a rotatable reel member 31, a pull string 32 and a first biasing member 33. The reel member 31 has an inner groove 315, and is mounted rotatably in the reel accommodating portion 213. The pull string 32 is wound on the reel member 31, and has a distal section 321. The distal section 321 passes through the channel 219 and the string hole 223 of the clamp member 20, and extends upwardly to connect with the knot 13. The first biasing member 33 biases the reel member 31 so as to wind the pull string 32 on the reel member 31, thereby pulling the knot 13 toward the clamp member 20. In this embodiment, the first biasing member 33 is a spiral spring having an innermost end 331 inserted into the groove 215 in the reel accommodating portion 213 of the casing 23 and an outermost end 332 connected to the inner groove 315 of the reel member 31, as best illustrated in FIG. 5.

Figure 6:
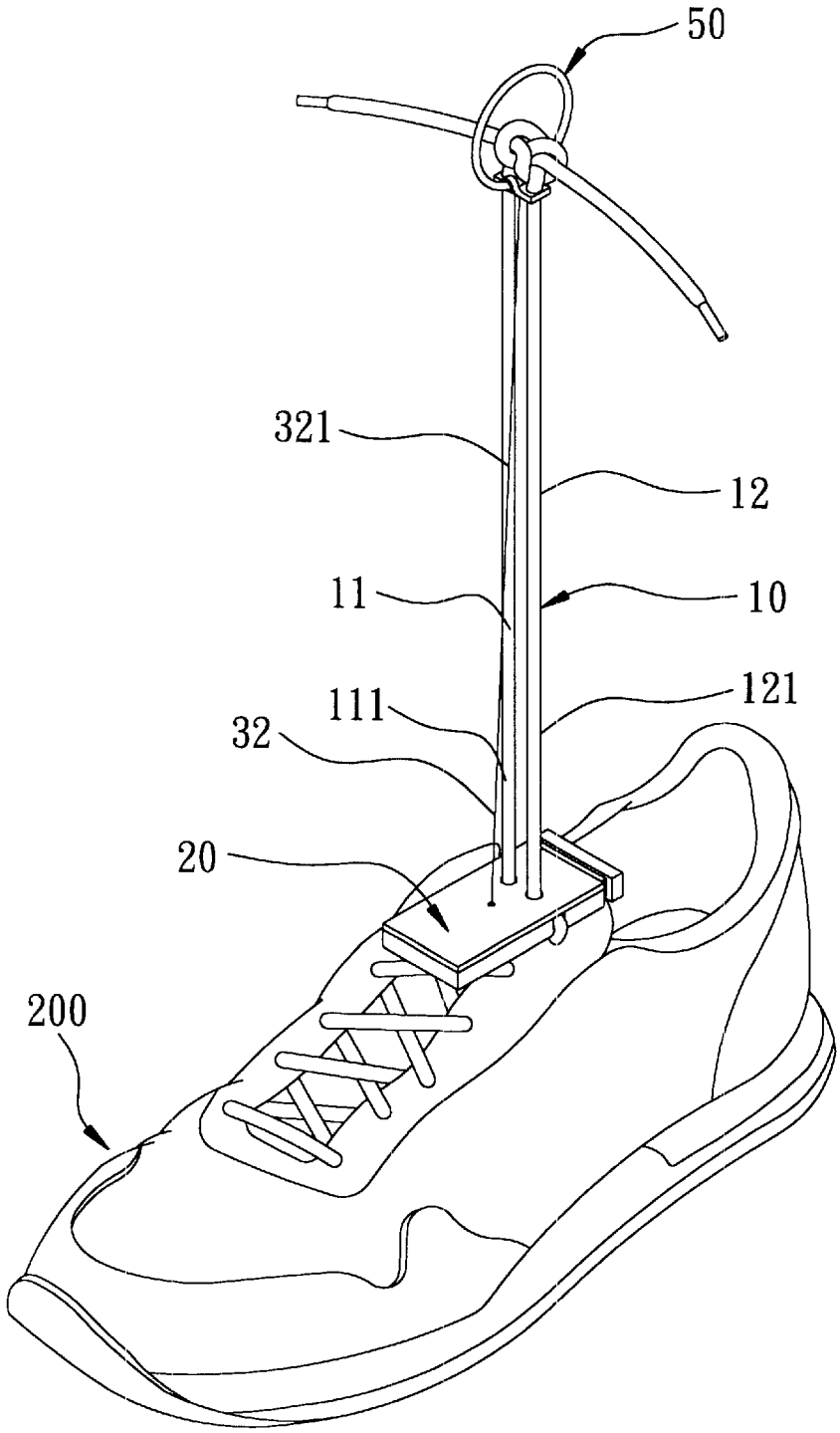
FIG. 6 is a perspective view illustrating how lower ends of the lace portions of a shoe lace are clamped by the clamp member in the first preferred embodiment.

The double-bow shoe lace device 100 further comprises a guide plate 40 and a pull ring 50. The guide plate 40 is disposed between the knot 13 and the clamp member 20, and is formed with a pair of lace holes 41, a pair of retaining holes 42 (only one is visible), and a string hole 43, as shown in FIGS. 3, 4 and 6. The lace holes 41 permit the medial sections 113, 123 of the first and second lace portions 11, 12 to extend fittingly therethrough. The string hole 43 permits the distal section 321 of the pull string 32 to extend therethrough so as to connect with the knot 13. The pull ring 50 extends through the retaining holes 42 of the guide plate 40, and is disposed between the knot 13 and the guide plate 40.

In use, by pulling the pull ring 50 upwardly, the distal section 321 of the pull string 32 is pulled out of the positioning unit 30, thereby winding the first biasing member 33. At this time, the clamp member 20 is forced to move downwardly, thereby bringing the lower sections 111, 121 of the lace portions 11, 12 closer together for tightening the shoe 200, as shown in FIG. 6. After the shoe 200 is tightened, the pull ring 50 is released, and the biasing action of the first biasing member 33 causes the pull string 32 to wind on the reel member 31, thereby pulling the knot 13 toward the clamp member 20, as shown in FIG. 7. The first and second loops (I), (II) of the medial sections 113, 123, and the distal lace ends 14 of the knot 13 cooperate to form a double-bow configuration.

Figure 8:
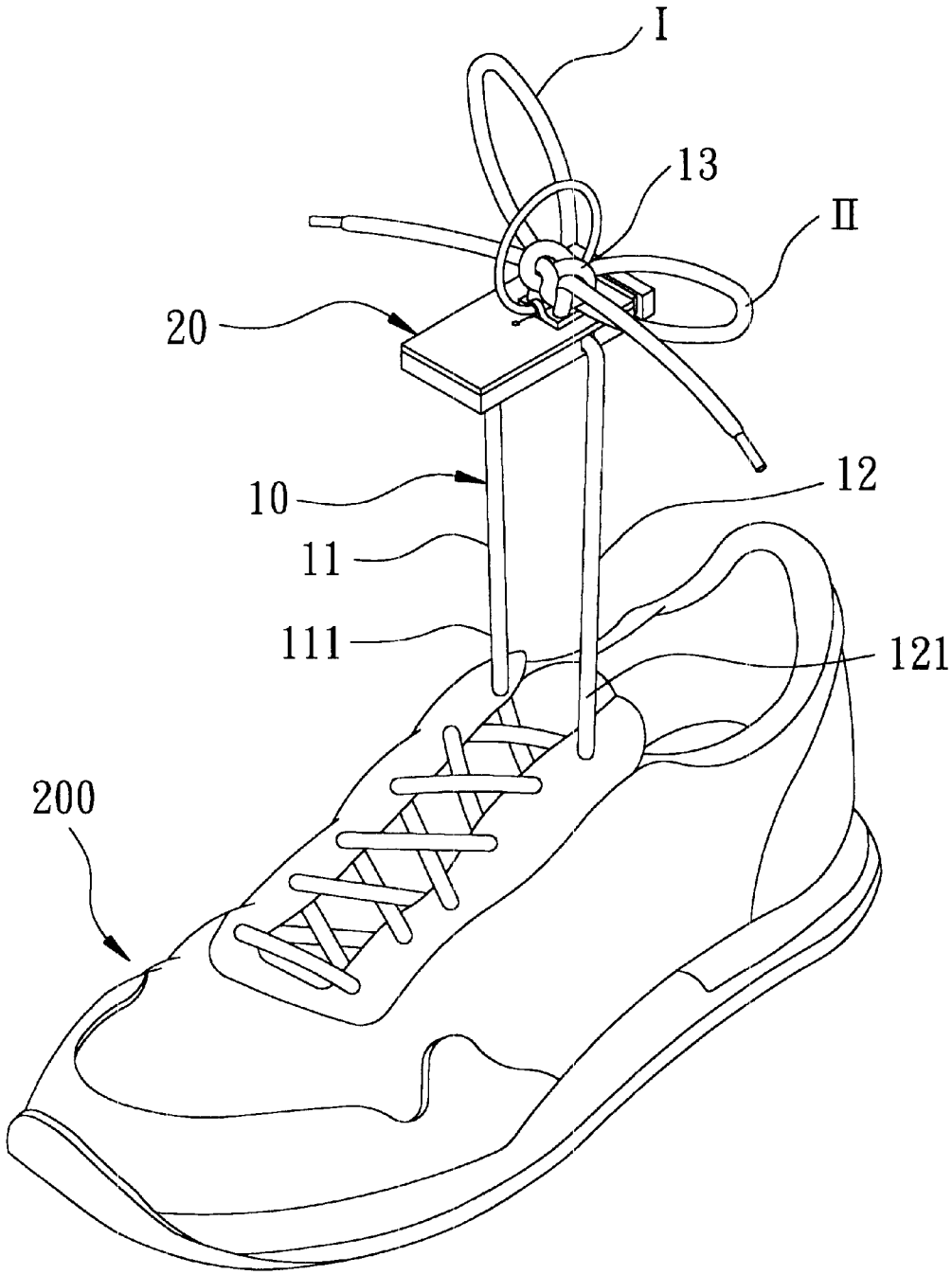
FIG. 8 is a perspective view illustrating how upward movement of the clamp member in the first preferred embodiment permits the lower ends of the lace portions to move away from each other so as to loosen the shoe.

To loosen the shoe 200, the clamping block 24 is operated to compress the second biasing member 25, and to align the groove units 243 with the hole units 218. At this time, by moving the clamp member 20 upwardly along the lace portions 11, 12, the lower sections 111, 121 of the latter can move away from each other for loosening the shoe 200, as shown in FIG. 8.

It has thus been shown that, the shoe 200 is not only easy to wear and remove, but also has an attractive appearance in view of the double-bow configuration of the double-bow shoe lace device 100.

Figure 9:
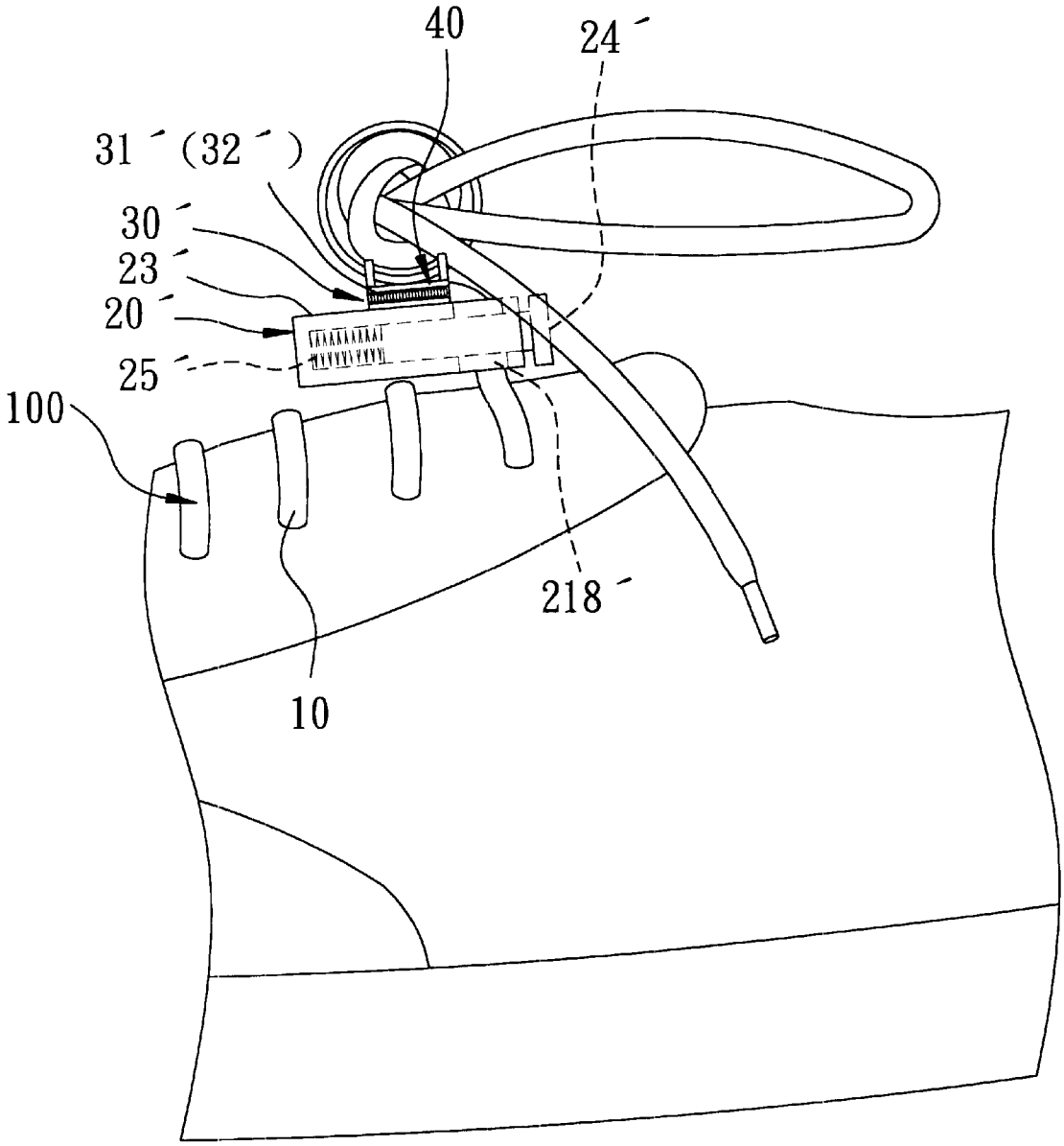
FIG. 9 is a fragmentary schematic view illustrating a shoe with the second preferred embodiment of a double-bow shoe lace device according to the present invention.

FIG. 9 illustrates the second preferred embodiment of a double-bow shoe lace device 100 according to the present invention. Unlike the first preferred embodiment, the clamp member 20' includes an elongate casing 23', a clamping block 24', and a second biasing member 25'. The elongate casing 23' has an open lateral side, and is formed with a hole unit 218' that permits extension of the medial sections of the first and second lace portions of the shoe lace 10. The clamping block 24' is slidably received in the casing 23', and is formed with a groove unit (not visible) for extension of the medial sections of the first and second lace portions. The second biasing member 25' is disposed in the casing 23', and biases the clamping block 24' toward the open lateral side of the casing 23', thereby clamping the medial sections of the first and second lace portions between the clamping block 24' and the casing 23'. In this embodiment, the positioning unit 30' includes a hook fastener 32' and a loop fastener 31'. The hook fastener 32' is secured on the bottom side of the guide plate 40. The loop fastener 31' is secured on the casing 23' of the clamp member 20' to engage removably the hook fastener 32'.

Figure 10:
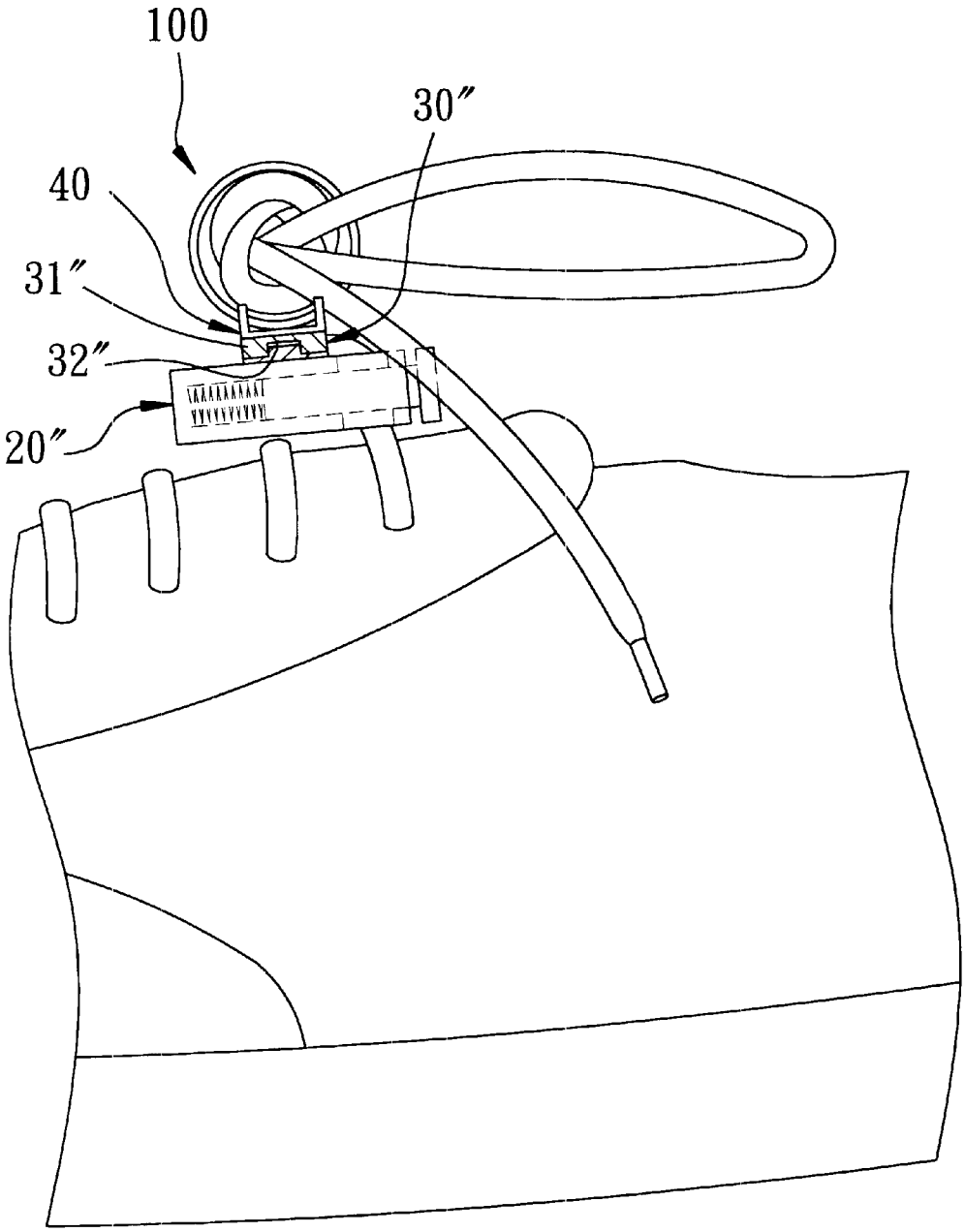
FIG. 10 is a fragmentary schematic view showing a shoe with the third preferred embodiment of a double-bow shoe lace device according to the present invention.

As shown in FIG. 10, the third preferred embodiment of a double-bow shoe lace device 100 according to the present invention is shown to be substantially similar to the first and second preferred embodiments. The main difference between this embodiment and the two previous embodiments resides in the structure of the positioning unit 30". The positioning unit 30" includes a male fastener 32" and a female fastener 31". The male fastener 32" is secured on the clamp member 20". The female fastener 31" is secured on the bottom side of the guide plate 40 to engage removably the male fastener 32".

Preferably, one of the male and female fasteners 32", 31" is magnetic, whereas the other of the male and female fasteners 32", 31" is magnetically attractive.

Figure 11:
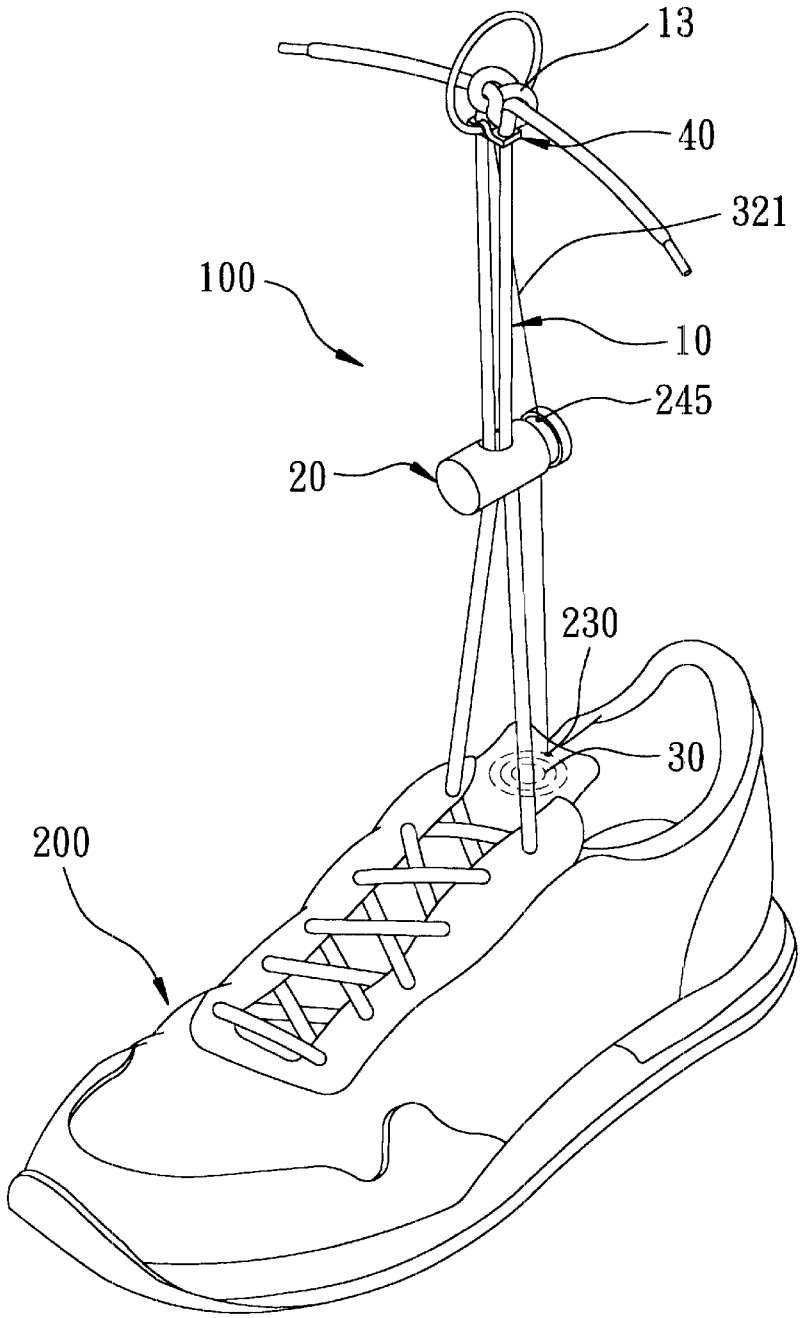
FIG. 11 is a perspective view illustrating a shoe with the fourth preferred embodiment of a double-bow shoe lace device according to the present invention.

Referring to FIG. 11, the fourth preferred embodiment of a double-bow shoe lace device 100 according to the present invention is shown to be substantially similar to the first preferred embodiment. However, unlike the first preferred embodiment, the positioning unit 30 is embedded in the tongue 230 of the shoe 200. The distal section 321 of the pull spring 32 passes through a hole 245 in the clamp member 20 and extends through the guide plate 40 so as to connect with the knot 13.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A double-bow shoe lace device for a shoe with a pair of eyelet tabs and a tongue between the eyelet tabs, said shoe lace device comprising:

a shoe lace having first and second lace portions, each of which has a lower section, an upper section, and a medial section between said lower and upper sections, said lower section of each of said first and second lace portions being adapted to be anchored on a respective one of the eyelet tabs, said upper sections of said first and second lace portions being tied together to form a knot and a pair of distal lace ends that extend from said knot;

a clamp member sleeved slidably on said medial sections of said first and second lace portions, downward movement of said clamp member along said medial sections bringing said lower sections of said first and second lace portions closer together for tightening the shoe, upward movement of said clamp member along said medial sections permitting said lower sections of said first and second lace portions to move away from each other for loosening the shoe; and a positioning unit, connected to said knot and said clamp member, for positioning said knot on said clamp member such that said medial sections of said first and second lace portions form first and second loops between said knot and said clamp member, wherein said positioning unit includes:

a rotatable reel member;

a pull string wound on said reel member and having a distal section passing through said clamp member and connected to said knot; and a first biasing member for biasing said reel member so as to wind said pull string on said reel member, thereby pulling said know toward said clamp member.

2. The double-bow shoe lace device of claim 1, wherein said clamp member includes:

an elongate casing formed with a reel accommodating portion and a lace retention portion adjacent to said reel accommodating portion, said reel accommodating portion having said reel member mounted rotatably therein, and being formed with a string hole to permit said distal section of said pull string to pass therethrough, said lace retention portion having an open lateral side and being formed with a pair of hole units that permit extension of said medial sections of said first and second lace portions therethrough;

a clamping block slidably received in said lace retention portion and formed with a pair of groove units that correspond respectively to said hole units in said lace retention portion for extension of said medial sections of said first and second lace portions; and a second biasing member disposed in said lace retention portion and biasing said clamping block toward said open lateral side of said lace retention portion, thereby clamping said medial sections of said first and second lace portions between said clamping block and said casing.

3. The double-bow shoe lace device of claim 2, wherein said first biasing member is a spiral spring having an innermost end connected to said casing and an outermost end connected to said reel member.

4. The double-bow shoe lace device of claim 2, wherein said casing includes a lower base with an upright peripheral wall, and an upper cover plate mounted on said upright peripheral wall, each of said hole units including an upper hole part formed in said upper cover plate, and a lower hole part formed in said upright peripheral wall.

5. The double-bow shoe lace device of claim 1, further comprising a guide plate formed with a pair of lace holes to permit said medial sections of said first and second lace portions to extend fittingly therethrough, and a string hole to permit said distal section of said pull string to extend therethrough, said guide plate being disposed between said knot and said clamp member.

6. The double-bow shoe lace device of claim 5, further comprising a pull ring connected to said guide plate.

7. The double-bow shoe lace device of claim 1, wherein said clamp member includes:

an elongate casing having an open lateral side and formed with a hole unit that permits extension of said medial sections of said first and second lace portions therethrough;

a clamping block slidably received in said casing and formed with a groove unit for extension of said medial sections of said first and second lace portions; and a second biasing member disposed in said casing and biasing said clamping block toward said open lateral side of said casing, thereby clamping said medial sections of said first and second lace portions between said clamping block and said casing.

8. The double-bow shoe lace device of claim 1, wherein said positioning unit is adapted to be embedded in the tongue of the shoe.

9. A double-bow shoe lace device for a shoe with a pair of eyelet tabs and a tongue between the eyelet tabs, said shoe lace device comprising:

a shoe lace having first and second lace portions, each of which has a lower section, an upper section, and a medial section between said lower and upper sections, said lower section of each of said first and second lace portions being adapted to be anchored on a respective one of the eyelet tabs, said upper sections of said first and second lace portions being tied together to form a knot and a pair of distal lace ends that extend from said knot;

a clamp member sleeved slidably on said medial sections of said first and second lace portions, downward movement of said clamp member along said medial sections bringing said lower sections of said first and second lace portions closer together for tightening the shoe, upward movement of said clamp member along said medial sections permitting said lower sections of said first and second lace portions to move away from each other for loosening the shoe; and a positioning unit, connected to said knot and said clamp member, for positioning said knot on said clamp member such that said medial sections of said first and second lace portions form first and second loops between said knot and said clamp member, wherein said positioning unit includes a hook fastener provided on one of said knot and said clamp member, and a loop fastener provided on the other of said knot and said clamp member to engage removably said hook fastener.

10. A double-bow shoe lace device for a shoe with a pair of eyelet tabs and a tongue between the eyelet tabs, said shoe lace device comprising:

a shoe lace having first and second lace portions, each of which has a lower section, an upper section, and a medial section between said lower and upper sections, said lower section of each of said first and second lace portions being adapted to be anchored on a respective one of the eyelet tabs, said upper sections of said first and second lace portions being tied together to form a knot and a pair of distal lace ends that extend from said knot;

a clamp member sleeved slidably on said medial sections of said first and second lace portions, downward movement of said clamp member along said medial sections bringing said lower sections of said first and second lace portions closer together for tightening the shoe, upward movement of said clamp member along said medial sections permitting said lower sections of said first and second lace portions to move away from each other for loosening the shoe; and a positioning unit, connected to said knot and said clamp member, for positioning said knot on said clamp member such that said medial sections of said first and second lace portions form first and second loops between said knot and said clamp member, wherein said positioning unit includes a male fastener provided on one of said knot and said clamp member, and a female fastener provided on the other of said knot and said clamp member to engage removably said male fastener, and wherein one of said male and female fasteners is magnetic, and the other of said male and female fasteners is magnetically attractive.

* * * * *